United States Patent [19]

Specht

[11] 4,191,627

[45] Mar. 4, 1980

[54] REINFORCED CASING FOR AN ELECTRODE FOR A DIAPHRAGM-TYPE ELECTROLYTIC CELL AND A METHOD OF FABRICATION

[75] Inventor: Steven J. Specht, Mentor, Ohio

[73] Assignee: Olin Corporation, New Haven, Conn.

[21] Appl. No.: 937,358

[22] Filed: Aug. 28, 1978

Related U.S. Application Data

[63] Continuation-in-part of Ser. No. 772,412, Feb. 28, 1977.

[51] Int. Cl.[2] ..... C25B 13/02; C25B 13/08; C25B 11/03; B32B 31/00

[52] U.S. Cl. ..... 204/296; 204/283; 156/226; 156/290

[58] Field of Search ..... 204/279, 282, 296, 252, 204/283; 429/139; 156/226, 290

[56] References Cited

U.S. PATENT DOCUMENTS

| | | | |
|---|---|---|---|
| 2,570,677 | 10/1951 | Honey et al. | 429/139 |
| 2,934,585 | 4/1960 | Zahn | 429/139 |
| 3,013,100 | 12/1961 | Mendelsohn et al. | 204/296 X |
| 4,110,191 | 8/1978 | Specht et al. | 204/296 X |
| 4,115,237 | 9/1978 | Woodward et al. | 204/252 X |

FOREIGN PATENT DOCUMENTS

| | | | |
|---|---|---|---|
| 637357 | 2/1962 | Canada | 429/139 |

*Primary Examiner*—John H. Mack
*Assistant Examiner*—D. R. Valentine
*Attorney, Agent, or Firm*—Bruce E. Burdick; Thomas P. O'Day

[57] ABSTRACT

A casing suitable for covering a substantially rectangular electrode for a diaphragm-type electrolytic cell comprises a closed end, an open end, and two closed, reinforced sides.

The casing is formed of a single flexible material which is folded or sealed to provide a plurality of fingers each having a closed end and then sealed to form two closed sides, such casing preferably having reinforced edges.

16 Claims, 18 Drawing Figures

REINFORCED CASING FOR AN ELECTRODE FOR A DIAPHRAGM-TYPE ELECTROLYTIC CELL AND A METHOD OF FABRICATION

This case is a continuation-in-part of commonly assigned patent application Ser. No. 772,412 filed Feb. 28, 1977.

This invention relates to diaphragm-type electrolytic cells for the electrolysis of aqueous salt solutions. More particularly, this invention relates to a method of forming a casing for an electrode in a diaphragm-type electrolytic cell.

For years commercial diaphragm cells have been used for the production of chlorine and caustic soda which employed a deposited fiber diaphragm, usually asbestos. While quite satisfactory for producing chlorine, the caustic soda was of a relatively low concentration and contained considerable amounts of undesired sodium chloride.

Recently materials have been produced which may be employed as diaphragms to produce caustic soda of increased concentration while significantly reducing the sodium chloride content. These materials, having ion exchange properties, are produced from one or a combination of polymeric materials. The materials have previously been fabricated in the form of continuous sheets to extend over a group of electrodes by sealing a multiplicity of sheets together end to end. They may also be produced in the form of a casing which is attached to individual electrodes. It is important that the attachment of the fabricated diaphragms be accomplished in a manner which will effectively seal the diaphragm to prevent undesired leakage into or out of the electrode compartment. Leakage resulting from poor seals along seams or joints can result in a substantial reduction in current efficiency.

It is known in the prior art to attach fabricated diaphragms, for example, by means of clamps or expansible retainers. U.S. Pat. No. 1,797,377 employs clamps having offset claws which straddle two ends of the diaphragm covered electrode, pinching them together and pressing the edges between the clamp and a support plate. This method does not effectively seal the area across the top of the electrodes and requires the diaphragm be separately clamped to each electrode with no cooperation between adjoining clamps.

Flexible retainers are employed to secure a diaphragm in U.S. Pat. No. 3,878,082 where a U-shaped compressible retainer is used in combination with a crescent-shaped expansible retainer. The crescent-shaped retainer is placed over the diaphragm in the area between adjacent cathodes so that one end extends over a portion of one cathode and the other end covers a portion of the adjacent cathode. The U-shaped retainer is placed on top of the cathode so that it clamps down over one end each of two adjacent crescent-shaped retainers.

U.S. Pat. No. 3,880,554 issued to Grot discloses a procedure for heat sealing after prior chemical treatment, which can be utilized to allow heat sealing of the casing of this invention.

U.S. Pat. No. 3,980,544 discloses securing a fabricated diaphragm covering electrodes using clamps which seal an adjoining edge of each of two adjacent diaphragms. The clamps are thus positioned between adjacent electrodes, with a pair of clamps being required for each electrode. While the clamps satisfactorily seal the open ends of the diaphragm, it is desirable to improve the ease of sealing the diaphragm along the top and bottom edges.

Therefore, it is an object of the present invention to provide a casing for enclosing an electrode which utilizes weak casing materials yet has sufficient seal strength. By "weak casing" or "weak separator" is meant a separator of insufficient strength to resist mechanical forces thereon during operation of the cell.

Another object of the present invention is to provide a casing for enclosing an electrode which is much simpler to fabricate than previously possible.

These and other objects of the present invention are accomplished in a casing for a substantially rectangular electrode for a diaphgram-type electrolytic cell, the casing comprising a closed end, an open end, and two reinforced closed sides.

The novel casing of the present invention is formed by a method which comprises forming a casing adapted to cover a substantially rectangular electrode, said casing being comprised of a flexible material suitable for use as a separator in a diaphragm-type electrolytic cell for the electrolysis of alkali metal chlorides, said casing having, a closed end, two closed sides and an open end, said method which comprises:

(a) forming a closed end of said casing, and (b) forming two integrally-reinforced, heat-sealed closed sides of said casing.

Accompanying FIGS. 1–18 illustrate the novel casing of the present invention. Corresponding parts have the same numbers in all Figures.

Figure 1:
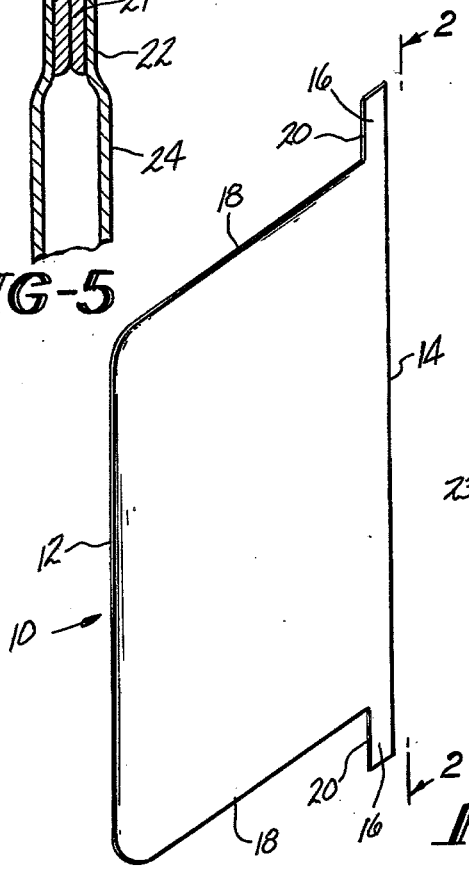
FIG. 1 represents a side view in perspective of one embodiment of the casing of the present invention.
Figure 2:
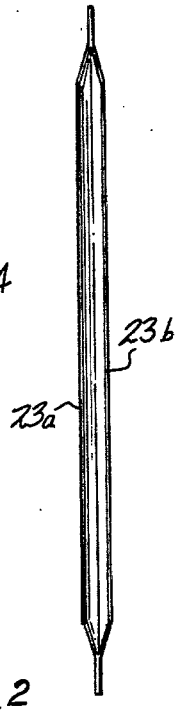
FIG. 2 illustrates a rear view of the casing of FIG. 1.
Figure 3:
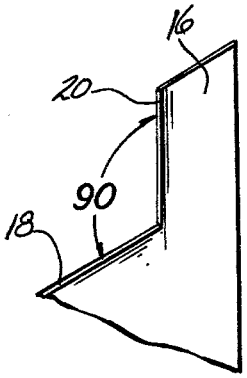
FIG. 3 shows details of one tab on the casing of FIG. 1.

FIGS. 1-3 illustrate one embodiment of the present invention in which casing 10, made of two sheets 23a and 23b of a flexible material, has a closed end 12 and an open end 14 and tabs 16 form the upper and lower extremities of open end 14. Closed edges 18 are formed by providing substantially linear seals along edges of sheets 23a and 23b which terminate at tabs 16, although other non-linear seals could be used depending on the sealing machine used and the electrode design and desired membrane or diaphragm shape. Tabs 16 are sealed along edges 20 adjacent to closed edges 18 by providing a seal which is angular to the seals of closed edges 18. For the embodiment of FIGS. 1-3, the external angle between edges 18 and 20 is about 90°, as best illustrated in FIG. 3.

Figure 4:
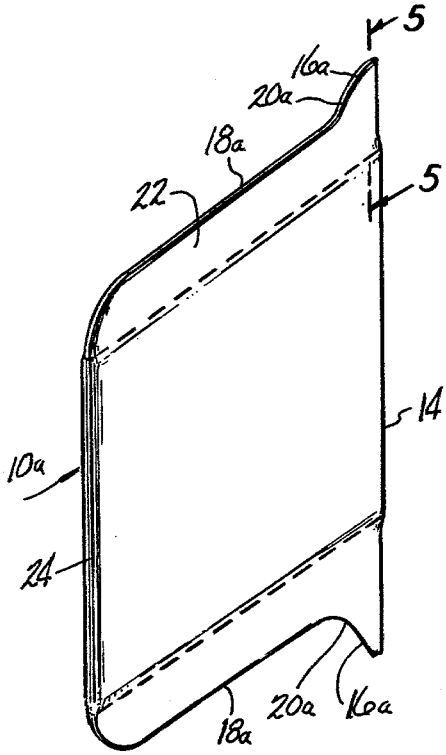
FIG. 4 depicts a side view in perspective of another embodiment of the casing of the present invention.
Figure 5:
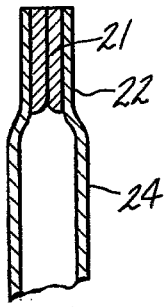
FIG. 5 represents a front view of a partial section of the casing of FIG. 4.

FIGS. 4 and 5 show another embodiment of the casing of the present invention in which casing 10a is formed by bonding border sections 22 to central section 24 where different materials are employed for the border sections and the central section. This is preferably done by laminating a strip 21 of a reinforcing material, e.g. T-24 Teflon ® fabric by DuPont de Nemours, Inc. on top of the outer or edge sections 22 of the casing so that the entire casing 10a has cation exchange properties. (See FIGS. 10-16 described below.) Closed edges 18a and tabs 16a are formed on the border section. The external angle between edge 20a of tabs 16a and the linear seals on closed edges 18a is greater than 90°.

Figure 6:
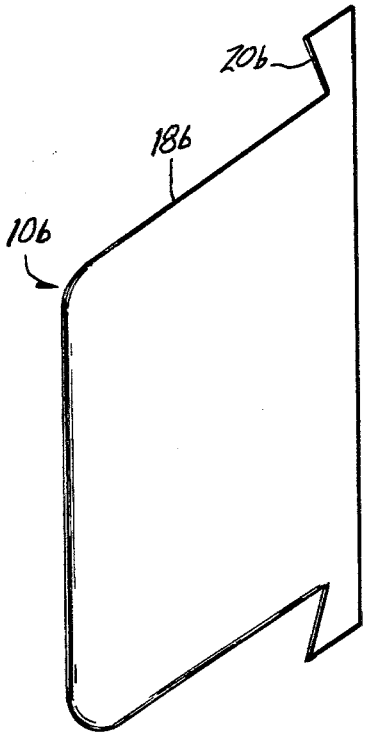
FIG. 6 illustrates a side view in perspective of an additional embodiment of the casing of the present invention.

FIG. 6 represents a further embodiment having a casing 10b in which the external angle between sealed edges 20b of tabs 16b and sealed closed edges 18b is less than 90°.

Figure 7:
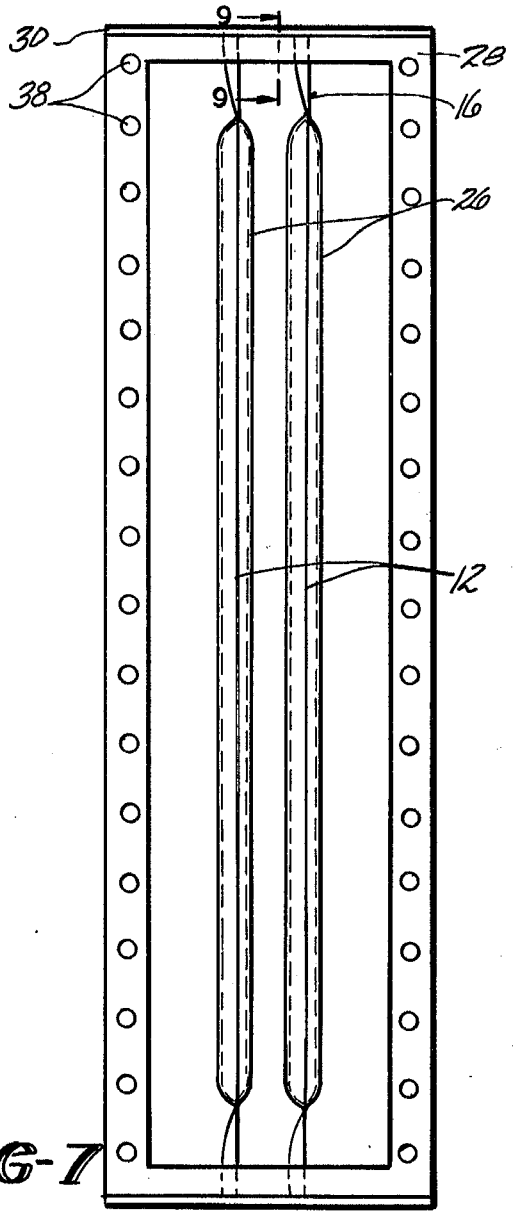
FIG. 7 illustrates a front view of a pair of electrodes covered by the casing of the present invention.
Figure 8:
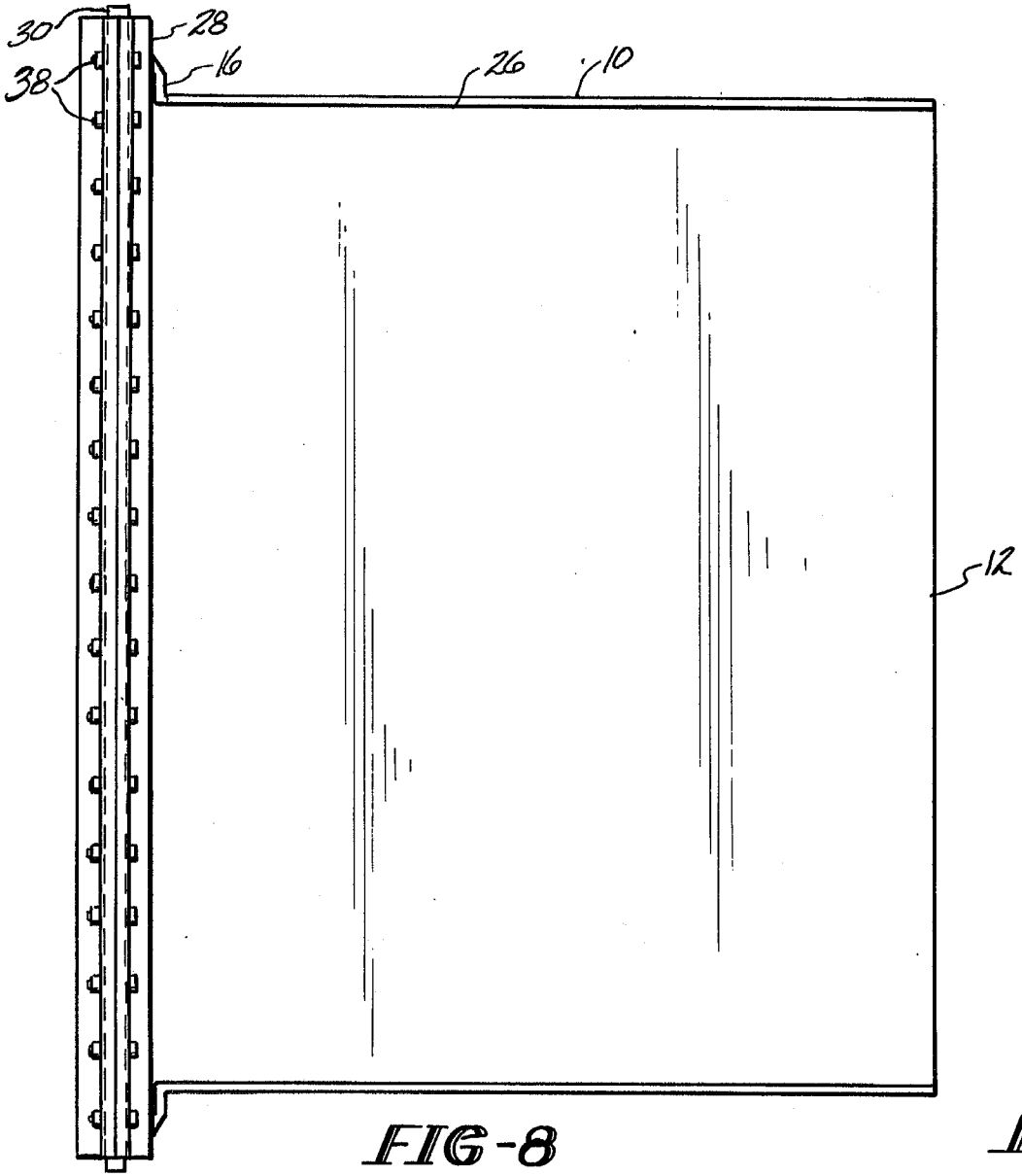
FIG. 8 represents a side view of one electrode of FIG. 7.

FIG. 7 is a front view of a pair of electrodes 26 covered by the casing of the present invention. As shown in FIG. 7 and the side view of FIG. 8, electrode 26 is enclosed by casing 10 having closed end 12. Tabs 16 are twisted and are covered in part by clamp 28. Clamp 28 seals tabs 16 against flange 30 for example, using bolts 38.

Figure 9:
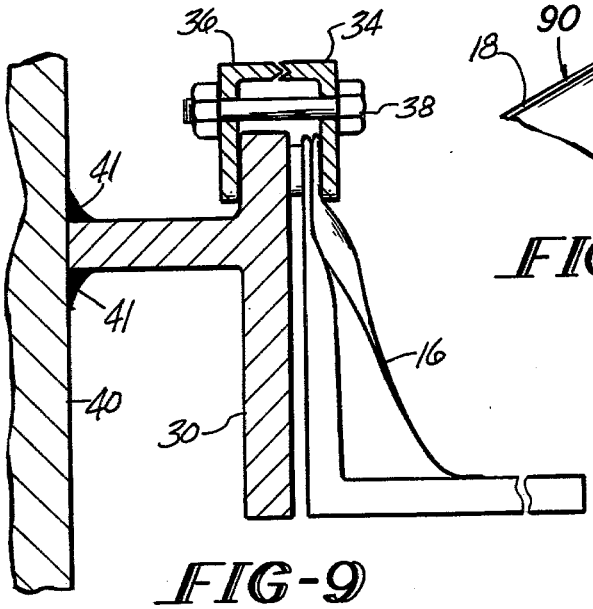
FIG. 9 illustrates a partial section of FIG. 7 taken alone line 9—9.

Clamps 28, as illustrated in FIG. 9, have an upper portion 34 and a lower portion 36 which are joined by bolt 38 and, after tabs 16 are folded, seal tabs 16 against flange 30 so that tabs 16 lie coplanar to backplate 40 to which flange 30 is attached, for example, by welding at points 41. In this position, longitudinal forces on casing 10 will be passed through the body of tab portions 16 rather than through the seals and will thus not tend to separate the seals, which have a much lower tear strength than the tensile strength or tear strength of the casing material.

The novel casing of the present invention is comprised of a material which can be used as a porous diaphragm or an ion exchange membrane in an electrolytic cell of the diaphragm type. The material should be flexible and capable of being sealed, for example, by means such as heat sealing, sewing, or by the application of sealants. Heat sealing is currently preferred. Suitable materials include plastics such as polytetrafluoroethylene, polypropylene or polyvinylidene chloride; sheets or fabrics of inorganic materials such as asbestos; and ion exchange resins.

Ion exchange resins which can be used as casing materials include fluorocarbons having the units:

$$-(C_mF_2)_M- \text{ and } -\left(CF_2-\underset{\underset{X}{|}}{CF}\right)_N$$

where m is from 2 to 10, the ratio of M to N is sufficient to provide an equivalent weight of from 600 to 2000, and is selected from:

(i) A, or $$-\left(OCF_2-\underset{\underset{Z}{|}}{CF}\right)_p-A \qquad \text{(ii)}$$

where p is from 1 to 3 and Z is F or a perfluoroalkyl group having from 1 to 10 carbon atoms provided that in either of these cases (i) and (ii), A is a group selected from:

$SO_3H$, $CF_2SO_3H$, $CCl_2SO_3H$, $X'SO_3H$, $PO_3H_2$, $PO_2H_2$,

COOH, and

X'OH where X' is an arylene group.

Preferred ion exchange resins are those in which X is COOH, $SO_3H$, $OCF_2—CF_2—SO_3H$, or $OCF_2—CF_2—COOH$.

Suitable casings are fabricated from perfluorocarboxylic acid resins having the formula:

$$CF_2CF_2\underset{\underset{(OCF_2\underset{\underset{CF_3}{|}}{C}F)_n-OCF_2CF_2COOH}{|}}{CF}$$

where n is an integer of 0 to about 3.

Preferred materials for the casings of the present invention are perfluorosulfonic acid resins comprised of copolymers of a perfluoroolefin and a fluorosulfonated perfluorovinyl ether. Suitable perfluoroolefins include tetrafluoroethylene, hexafluoropropylene, octafluorobutylene and higher homologues. Preferred perfluoroolefins include tetrafluoroethylene and hexafluoropropylene, with tetrafluoroethylene being particularly preferred. The fluorosulfonated perfluorovinyl ethers are compounds of the formula $FSO_2CFRCF_2O[CFYCF_2O]_n CF{=}CF_2$(I), where R is a radical selected from the group consisting of fluorine and perfluoroalkyl radical having from 1 to about 8 carbon atoms, Y is a radical selected from the group consisting of fluorine and trifluoromethyl radicals; and n is an integer of 0 to about 3. Illustrative of such fluorosulfonated perfluorovinyl ethers are:

$FSO_2CF_2CF_2OCF{=}CF_2$, $FSO_2CF_2CF_2OCF(CF_3)CF_2OCF(CF_3)CF_2OCF{=}CF_2$, $FSO_2CF_2CF_2CF_2CF_2OCF(CF_3)CF_2OCF{=}CF_2$, and $FSO_2CF_2CF_2OCF(CF_3)CF_2OCF{=}CF_2$.

Preferred sulfonated perfluorovinyl ethers are those of formula I above in which R is fluorine and Y is trifluoromethyl.

A particularly preferred sulfonated perfluorovinyl ether is that of the formula:

$FSO_2CF_2CF_2OCF(CF_3)CF_2OCF{=}CF_2$, perfluoro[2-(2-fluorosulfonylethoxy) propyl vinyl ether].

The sulfonated perfluorovinyl ethers are prepared by methods described in U.S. Pat. No. 3,041,317 to Gibbs et al, 3,282,875 to Connolly et al, 3,560,568 to Resnick, and 3,718,627 to Grot.

The copolymers employed in the cationic permselective membrane of the present invention are prepared by methods described in U.S. Pat. Nos. 3,041,317 to Gibbs et al, 3,282,875 to Connolly et al, and 3,692,569 to Grot.

The solid fluorocarbon polymers are prepared by copolymerizing the perfluoroolefin, for example, tetrafluoroethylene with the sulfonated perfluorovinyl ether followed by converting the $FSO_2$ group to $SO_3H$ or a sulfonate group (such as an alkali metal sulfonate) or a mixture thereof. The equivalent weight of the perfluorocarbon copolymer ranges from about 900 to about 1600, and preferably from about 1100 to about 1500. The equivalent weight is defined as the average molecular weight per sulfonyl group.

A particularly preferred cation permselective membrane is a perfluorosulfonic acid resin composite membrane produced by E. I. DuPont de Nemours and Co. and sold commercially under the trademark "NAFION."

Also suitable as a casing is a commercially available material containing a stable perfluorinated compound which is sold by W. L. Gore and Associates, Inc., Elkton, Md., under the trademark "GORE-TEX."

A further preferred cation permselective membrane is a perfluorocarboxylic acid copolymer composite membrane manufactured by Asahi Glass Kabushiki Gaisha of Japan and described in Japanese Patent Publication (kokai) No. 1976-126398 issued Nov. 4, 1976.

Casings 10 of the present invention have a closed end 12, an open end 14, and two closed sides 18. At least one closed side 18 has a tab portion 16 which is adjacent to the open end 14. The tab 16 is flexible and can be turned or twisted (see FIG. 9) to provide a substantially flat surface on which clamping means 30 can be used to effectively seal the casings 10 along its perimeter.

The closed end 12 of the casing may be formed by folding a section of the material or by appropriately sealing two sections or sheets 23*a* and 23*b* of material together. A major portion 18 of the closed sides has a substantially linear seal. A minor tab portion 16 is preferably provided which has a seal which is angular to the seal on the major portion 18. In addition, the seal on the tab portion 16 is contiguous with the seal on the major portion 18 so that the casing 10, if membranous, is also leakproof along its sides. As illustrated in FIGS. 1, 3–4 and 6, the angle between the seal on the major portion 18 and the seal on the tab 16 may be any suitable one, for example, an external angle of from about 60° to about 120°, preferably from about 80° to about 100°. The internal angle is thus from about 300° to about 240°, and preferably from about 280° to about 260°. As illustrated in FIG. 3, the external angle is measured from a line which passes through or is parallel to the substantially linear seal along the major portion 18 of the closed sides. The length of the tab portion 16 is any suitable one which will provide a tab 16 which can be twisted or turned (see FIG. 9) so as to provide a substantially flat surface for sealing purposes. For example, tab portions 16 which have a length of from about 1 to about 8, and preferably from about 2 to about 6 inches are satisfactory. Any suitable width may be used for tab portions 16.

To provide casing 10 with suitable properties as a separator and also with suitable mechanical properties, it may be desirable, as shown in FIG. 4, to reinforce edge sections 22 in forming the casing. The central section 24, which serves as the primary separator during electrolysis, preferably has integrally attached along at least one edge a strip 21 of reinforcing material having desirable sealing properties and mechanical properties. The reinforcing strip 21 may also be chosen to have desirable cation exchange properties. The strip 21 or border section forms the closed side 18, 20 including the tab 16 and is attached to the central portion 24 of sheets 23*a* and 23*b*, for example by laminating or heat sealing, as illustrated in FIGS. 4–5. Each strip 21 is then sealed to itself or to a similar strip 21 of an adjacent sheet 23*a* or 23*b* to form closed edges 18, 20, the seal being substantially linear along the major portion of the side and angular along the tab portion. The tab can be pre-cut or its portion can be formed by cutting the material along the outside of the angular seal to separate the major portion from the tab portion.

Figure 10:
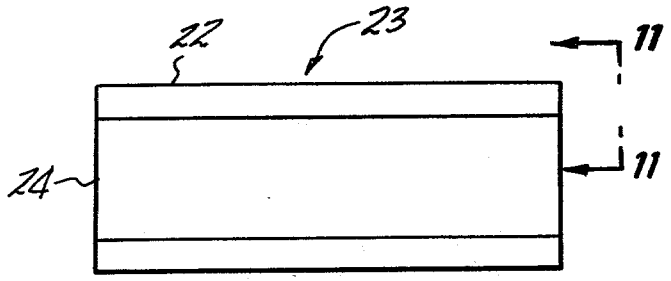
FIG. 10 is a top view of a separator sheet with integral reinforced borders.
Figure 11:
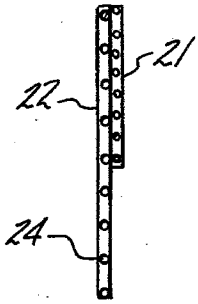
FIG. 11 is a partial end view of the sheet of FIG. 10 showing the reinforced border portion.
Figure 12:
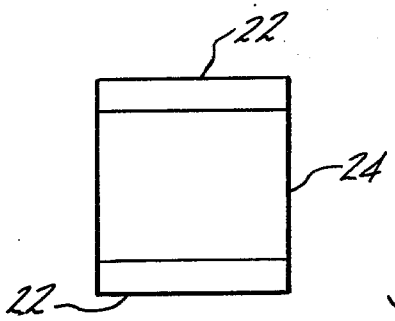
FIG. 12 depicts the beginning step in the casing fabrication process, showing the sheet of FIG. 10.
Figure 13:
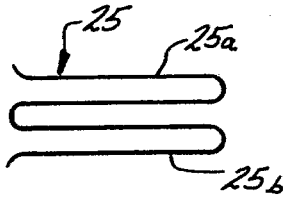
FIG. 13 is a side view of the sheet of FIGS. 10 and 12 in folded position prior to heat sealing.
Figure 14:
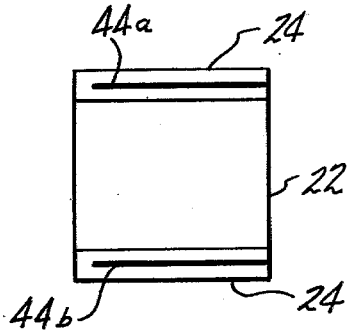
FIG. 14 is a top view showing a longitudinally heat sealed edge portion.
Figure 15:
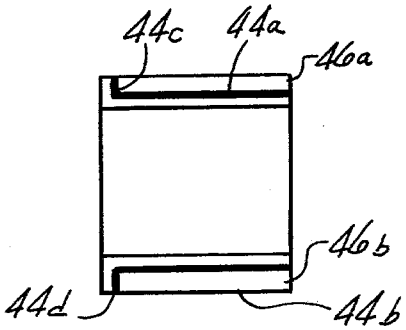
FIG. 15 is a top view showing a fully heat sealed edge section.
Figure 16:
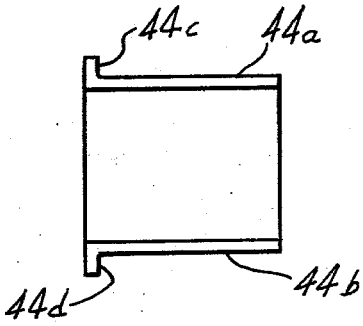
FIG. 16 is a top view of a fully heat sealed casing with excess edge material removed.
Figure 17:
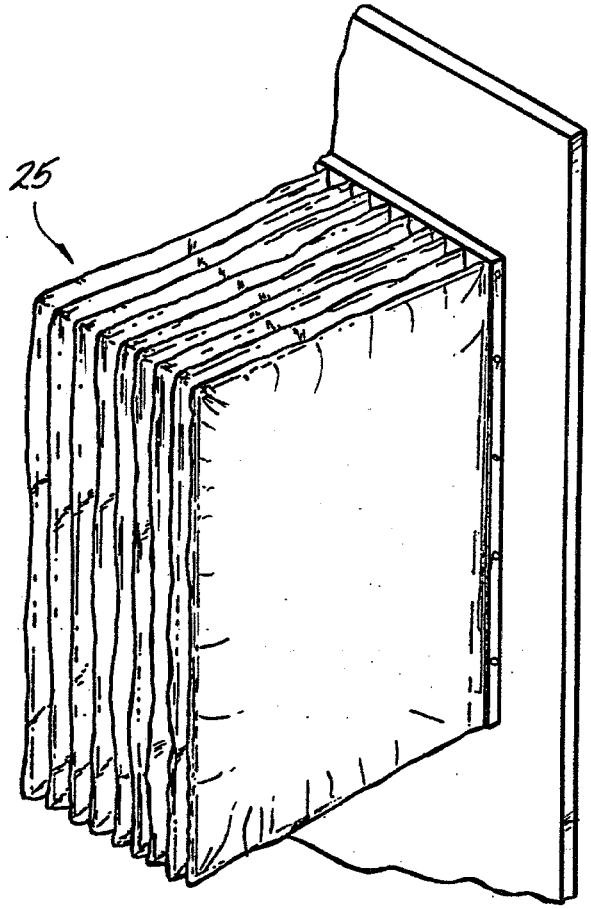
FIG. 17 shows a fully assembled casing in place about the electrodes of a chlor-alkali monopolar cell.
Figure 18:
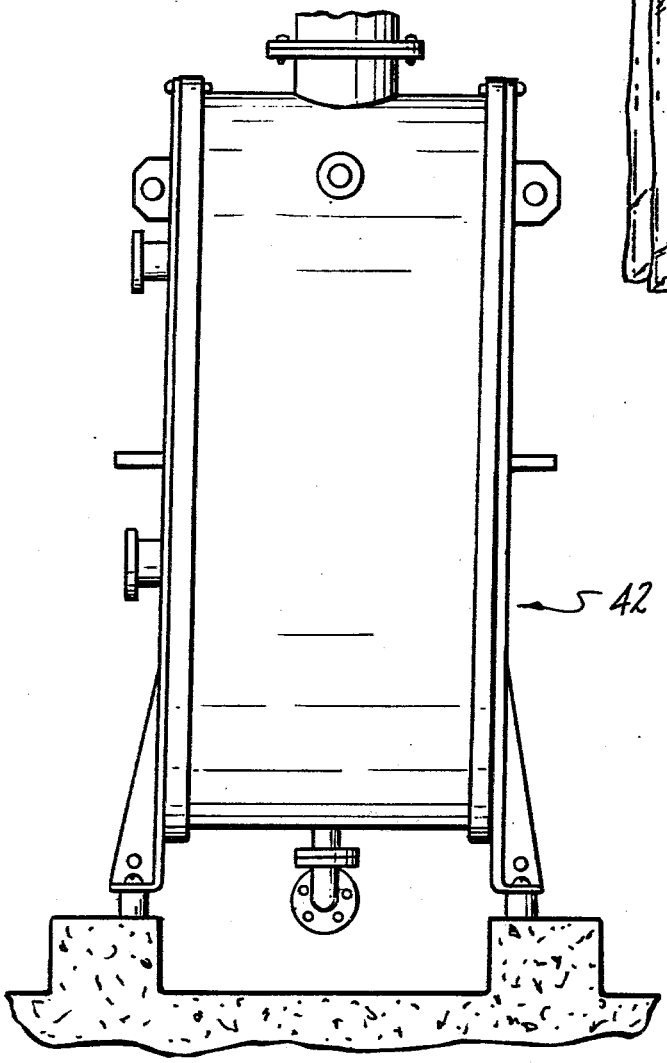
PRIOR ART FIG-18
FIG. 18 shows an overall external view of a monopolar cell in which the invention may be utilized.

The two different materials, seen in FIG. 4, are not attached end to end or with a partial overlap or seam. Rather, in this invention the reinforcing edge strip is laminated or otherwise integrally attached onto a separator sheet 23*a* or 23*b* as seen in FIGS. 10 and 11 by conventional laminating or other techniques. This attachment results in a single piece of separator material which is of sufficient length and width to serve as both sheets 23*a* and 23*b* as well as closed end 12 so as to form an entire membrane or diaphragm separator structure 25 (see FIG. 17) for use in a diaphragm or membrane monopolar cell 42 (e.g. FIG. 18) and which has integral mechanically reinforced borders 22 for additional strength in the areas to be heat sealed. This method reduces the number and length of the seals necessary to construct the casing 10 by eliminating the need to attach separate reinforcing border strips 21 to the sheets 23*a* and 23*b* by heat sealing during casing fabrication and eliminating the need to seal individual sheets 23*a* and 23*b* (see FIG. 2) together before an entire casing can be formed.

In the event the separator material is of sufficient strength to resist the mechanical stresses on the sealed areas caused by casing fabrication and cell operation, the reinforced border could be eliminated, however the single length of material of sufficient length to form an entire casing would still be of great advantage in reducing the number of seals necessary for fabrication of a casing for a monopolar diaphragm or membrane type chlor-alkali cell, thus making the monopolar cell a more desirable cell design than if many additional seals had to be made.

The reinforced border procedure allows the use of separator material of less strength in the central section 24 through which the primary current and ionic flow occurs, so that the separator materials of maximum efficiency can be utilized in monopolar cell designs, thus making such designs more desirable.

FIGS. 10 and 11 are top and end views, respectively, of a continuous sheet 23 of membrane material with reinforced edge sections 22 and unreinforced central section 24. The basic separator material can be, for example, one of DuPont de Nemours' NAFION® cation exchange membrane materials such as NAFION® 391. The strip reinforcing edge section 22 can be T-24 TEFLON® cloth or other reinforcing material which is able to be laminated or otherwise firmly attached to the separator sheet 23 and is caustic and brine resistant.

FIGS. 12–16 show the sequential four-step casing fabrication method. Separator sheet 23 with or without reinforcing edge strips 21 is doubled back and fourth as in FIG. 13 to form a membrane structure 25 and a plurality of sheets 23*a* and 23*b* which in turn form a plurality of membrane fingers 25*a* and 25*b*. These membrane fingers 25*a* and 25*b* are then heat sealed to form seals 44*a*, 44*b*, 44*c* and 44*d* in the reinforced edge 22, if any, as in FIGS. 14 and 15. Optionally, the excess edge material 46*a* and 46*b* is then trimmed off (see FIG. 15) to form a shape such as in FIG. 16 to form a glove-like membrane structure 25 similar to that of FIG. 17 for use in a monopolar cell 42 such as that of FIG. 18. Cell 42 is shown for illustrative purposes only and can be any otherwise conventional monopolar cell design such as for example that of commonly assigned U.S. Pat. No. 3,898,149 issued Aug. 5, 1975 to M. S. Kircher and E. N. Macken, herein incorporated by reference as if set forth at length.

While it is preferred to have a tab portion 16 on each of the closed edges, a suitable seal can be obtained by eliminating tab portions 16 altogether and providing a tab 16 on one closed side and sealing the "untabbed" closed side or sides by suitable means such as, for example, by the clamping method described in U.S. Pat. No. 3,980,544, issued to J. O. Adams, K. E. Woodard, Jr. and S. J. Specht.

In the method of forming the casing of the present invention, it is preferred to seal the materials by heat sealing. For example, where the casing is formed of a perfluorosulfonic acid resin, heat sealing temperatures of from about 50° to about 360° C., preferably from about 100° to about 300° C. may be utilized. Sealing pressures which may be employed include those of from about 1 to about 10 Kg/cm$^2$, and preferably from about 2 to about 6 Kg/cm$^2$. Using these temperatures and pressures, suitable dwell times during sealing may include those of from about 1 to about 10 seconds, preferably from about 2 to about 6 seconds.

The present invention is further illustrated by the following examples.

EXAMPLE 1

Two sheets of a perfluorosulfonic acid membrane material (E. I. DuPont de Nemours' NAFION® 427) were cut to provide a tab as illustrated in FIG. 1. NAFION® 427 is a homogeneous film 7 mils thick of 1200 equivalent weight perfluorosulfonic acid resin laminated with a T-12 fabric of polytetrafluoroethylene. Two edges of the sheets were heat sealed at a temperature of 260° C., a pressure of 3.0 Kg/cm$^2$ and a dwell time of 4.5 seconds on a thermal impulse heat sealing machine (Vertrod Inc., Brooklyn, N.Y.) to form a closed end. The sheets were then sealed linearly along each side up to the edge of the tab using the same heat sealing conditions as above. A heat seal was then applied to the tab portion at an angle of about 90° from the linear seal along each side. The seal was applied so that it interconnected with the linear seal along the major portion of the side edge. The tab portion was approximately 3 inches long. The casing was installed on an electrode used in a cell for the electrolysis of sodium chloride in the production of chlorine and sodium hydroxide. To provide a flat surface for sealing a casing along the top and bottom edges, the tabs were twisted and a clamp applied, as shown in FIG. 9. During electrolysis, the casing was found to be leak-proof and expanded or contracted with changes in cell operating conditions without placing a detrimental mechanical stress on the separator material.

EXAMPLE 2

A casing of the type illustrated in FIGS. 1–3 was fabricated starting with a sheet of a perfluorosulfonic acid membrane material (E. I. DuPont de Nemours' NAFION® 391). NAFION® 391 is a composite film having a layer 1 mil thick of 1500 equivalent weight perfluorosulfonic acid resin bonded to a layer 4 mils thick of 1100 equivalent weight perfluorosulfonic acid resin with the film being laminated to a T-900G fabric of polytetrafluoroethylene. Along the top edge and bottom edges of this sheet two strips of a second perfluorosulfonic acid membrane material (NAFION® 427) were heat sealed at a temperature of 260° C., a pressure of 3.0 Kg/cm$^2$ and a dwell time of 4.0 seconds, employing the heat sealing apparatus used in Example 1. The strips had been pre-cut to provide a tab adjacent to the end which would serve as the open end. The sheet was folded to form the closed end. The strips were then sealed together linearly along the top edge and along the bottom edge. The tab was then sealed to interconnect with the linear seals and at an angle of about 90° from the linear edge. These seals were made at the temperature and pressure employed above with a dwell time of 4.5 seconds. The casing fabricated with the border strips provided tabs of a material having superior mechanical stress properties to that used for the body of the casing.

EXAMPLE 3

A casing for a pilot monopolar membrane type chloralkali cell was fabricated from a fourteen foot length of NAFION® 391 (see Example 2) cation exchange membrane material. The material was 50 inches wide including integral reinforced borders which were five inches wide at each edge (see FIGS. 1 and 2). The support fabric for NAFION® 391 is DuPont de Nemours' T-900 TEFLON® cloth which is not strong enough for monopolar casing fabrication. Reinforced borders were obtained by laminating five inch wide strips of T-24 TEFLON® cloth over the NAFION® 391 material along the borders of the sheet.

Using this material, the casing fabrication was shortened to the four steps seen in FIGS. 12–16. The heat seals, which occurred only in the reinforced border sections, were made using a Thermal Impulse heater press with one-half inch wide heater bars (manufactured by Vertrod, Inc., Brooklyn, N.Y.). The machine settings for these seals were 260° C., 5.5 seconds dwell and 3 Kg/cm$^2$ jaw pressure.

The casing so fabricated has been used successfully in numerous pilot call tests without failure of heat seals.

What is claimed is:

1. A separator structure for use in a diaphragm-type electrolytic cell, which structure comprises:

(a) a single piece of separator material which is of sufficient length and width to form an entire separator structure but of insufficient strength to resist mechanical forces thereon during operation of said cell;

(b) said piece being doubled back and forth to form a glove-like structure of a plurality of interconnected finger portions, each finger portion having at least two closed heat sealed edges, one closed folded edge and one open edge, each of said open edges facing in a common direction;

(c) said piece having integral mechanically reinforced borders along the full length of two opposite edges of said piece; and (d) said borders being located such that the borders pass along the full length of said heat sealed edges, thereby reinforcing said edges.

2. The structure of claim 1, wherein said structure includes a tab, adjacent said open edge, said tab being adapted to be twisted against the portion of said structure interconnecting said finger portions to provide a substantially flat surface for sealing purposes.

3. The structure of claim 2 in which said tab has a length of from about 1 to about 8 inches.

4. The structure of claim 3 in which said structure is comprised of perfluorocarboxylic acid resins having the formula:

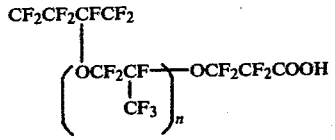

where n is an integer of 0 to about 3.

5. The structure of claim 3 in which said structure is comprised of copolymers of a perfluoroolefin and a fluorosulfonated perfluoro-polyvinyl ether where said copolymers have an equivalent weight of from about 900 to about 1600.

6. The structure of claim 5 in which said tab has a length of from about 2 to about 6 inches.

7. The structure of claim 6 in which said copolymers have an equivalent weight of from about 1100 to about 1500.

8. The structure of claim 3 in which said structure is comprised of a central section comprised of a first material, at least one border section laminated to said central portion, said border section forming a closed side and being comprised of a second material.

9. The structure of claim 8 in which said first material is a copolymer of a perfluoroolefin and a fluorosulfonated perfluoro-polyvinyl ether where said copolymer has an equivalent weight of from about 900 to about 1600.

10. The structure of claim 8 in which said second material is a copolymer of a perfluoroolefin and a fluorosulfonated perfluoro-polyvinyl ether where said copolymer has an equivalent weight of from about 900 to about 1600.

11. A method of forming a casing adapted to cover a substantially rectangular electrode, said casing being comprised of a flexible material suitable for use as a separator in a diaphragm-type electrolytic cell for the electrolysis of alkali metal chlorides, said casing having, a closed end, two closed sides and an open end, said method which comprises:

(a) forming a closed end of said casing;

(b) forming two integrally-reinforced, heat-sealed, closed sides of said casing;

(c) said flexible material is of sufficient length to form an entire casing;

(d) said method further comprises doubling said material back and forth to form a glove-like structure with open sides, and (e) sealing said open sides to form a plurality of finger portions, each finger portion having two closed sealed edges, one closed edge resulting from said doubling and an open edge, each of said open edges opening toward a common direction.

12. The method of claim 11 further comprising sealing said closed sides so as to include a major portion and a tab portion in which the external angle between said seal on said tab portion and said seal on said major portion is from about 60° to about 120°.

13. The method of claim 11 in which the length of said tab portion is from about 1 to about 8 inches.

14. The method of claim 11 in which said closed end is formed by folding a section of said material.

15. The method of claim 11 in which said casing is comprised of a perfluorosulfonic acid resin and said sides are formed by heat sealing at a temperature of from about 50° to about 360° C., a pressure of from about 1 to about 10 Kg/cm$^2$ and a dwell time of from about 1 to about 10 seconds.

16. The method of claim 15 in which said heat sealing is conducted at a temperature of from about 100° to about 300° C., a pressure of from about 2 to about 6 Kg/cm$^2$, and a dwell time of from about 2 to about 6 seconds.

* * * * *